US010506348B2

(12) United States Patent
Yamagami

(10) Patent No.: US 10,506,348 B2
(45) Date of Patent: Dec. 10, 2019

(54) SPEAKER

(71) Applicant: ALPINE ELECTRONICS, INC., Shinagawa-ku, Tokyo (JP)

(72) Inventor: Masaru Yamagami, Iwaki (JP)

(73) Assignee: Alpine Electronics, Inc., Tokyo (JP)

( * ) Notice: Subject to any disclaimer, the term of this patent is extended or adjusted under 35 U.S.C. 154(b) by 0 days.

(21) Appl. No.: 15/955,228

(22) Filed: Apr. 17, 2018

(65) Prior Publication Data

US 2018/0352336 A1 Dec. 6, 2018

(30) Foreign Application Priority Data

Jun. 2, 2017 (JP) ..... 2017-109642

(51) Int. Cl.

| | |
|---|---|
| ***H04R 9/06*** | (2006.01) |
| ***H04R 7/18*** | (2006.01) |
| ***H04R 7/12*** | (2006.01) |
| ***H04R 1/28*** | (2006.01) |
| ***H04R 9/02*** | (2006.01) |
| *H04R 9/04* | (2006.01) |
| *H04R 31/00* | (2006.01) |

(52) U.S. Cl.

CPC ..... *H04R 9/06* (2013.01); *H04R 1/288* (2013.01); *H04R 7/127* (2013.01); *H04R 7/18* (2013.01); *H04R 9/025* (2013.01); *H04R 7/12* (2013.01); *H04R 9/043* (2013.01); *H04R 31/006* (2013.01); *H04R 2400/11* (2013.01)

(58) Field of Classification Search

CPC ..... H04R 1/288; H04R 7/127; H04R 7/18; H04R 7/12; H04R 9/06; H04R 9/025; H04R 9/043; H04R 31/006; H04R 2400/11

See application file for complete search history.

(56) References Cited

U.S. PATENT DOCUMENTS

2007/0223775 A1 9/2007 Sugiura

FOREIGN PATENT DOCUMENTS

| | | | |
|---|---|---|---|
| JP | S55 9170 U | | 1/1980 |
| JP | S57 51395 U | | 3/1982 |
| JP | 2002-271889 | | 9/2002 |
| JP | 2002-271892 | | 9/2002 |
| JP | 2002271889 A | * | 9/2002 |
| JP | 2005-252923 | | 9/2005 |

OTHER PUBLICATIONS

Extended European Search Report for 18174877.3 dated Oct. 11, 2018, 8 pgs.

* cited by examiner

*Primary Examiner* — Joshua Kaufman
(74) *Attorney, Agent, or Firm* — Brinks Gilson & Lione

(57) ABSTRACT

A cap member is attached to an opening end portion of a bobbin on which a voice coil is wound. The cap member includes a bobbin reinforcement portion including a cylindrical portion and a bottom surface portion. The cylindrical portion opposes an inner surface of the bobbin, and the cylindrical portion and the inner surface of the bobbin are fixed to each other in at least a vibration plate fixed portion and a damper member fixed portion.

18 Claims, 7 Drawing Sheets

SPEAKER

RELATED APPLICATION

The present application claims priority to Japanese Patent Application Number 2017-109642, filed Jun. 2, 2017, the entirety of which is hereby incorporated by reference.

BACKGROUND

1. Field of the Invention

The present invention relates to a speaker in which an inner peripheral edge of a vibration plate is fixed to a bobbin having a voice coil wound thereon, and the bobbin and the vibration plate are driven by a current flowing in the voice coil and a magnetic field of a magnetic circuit portion.

2. Description of the Related Art

In a structure of a conventional speaker, a voice coil is wound on a bobbin and magnetic energy of a magnetic circuit portion is transmitted to the voice coil so that the magnetic energy is converted into kinetic energy of the voice coil and the bobbin. Further, a vibration is transmitted from the bobbin to a vibration plate, and sound energy is emitted into a space from the vibration plate. In this speaker, when the rigidity of the bobbin transmitting the kinetic energy is low, distortion and extra vibration are likely to occur in the bobbin. Particularly, since stress easily concentrates on a vibration plate fixed portion in the bobbin, the bobbin of the vibration plate fixed portion is easily deformed. As a result, a decrease in sound pressure and nonlinear distortion are likely to occur in the sound emitted from the vibration plate.

An approach of forming a part or the entirety of the bobbin of a metal material such as titanium or aluminum has been considered in order to improve the rigidity of the bobbin. However, in this approach, since the mass of the bobbin increases too much, a decrease in sound pressure cannot be solved effectively. Further, since the metal material is used, manufacturing cost increases.

A structure of a conventional speaker is shown in JP 2005-252923 A. In this speaker, a cone-shaped vibration plate is fixed to an outer surface of an intermediate portion away from an opening end portion of a bobbin on which a voice coil is wound, and a dust cap is fixed to the opening end portion of the bobbin.

In the speaker described in JP 2005-252923 A, since the dust cap is fixed to the opening end portion of the bobbin, the opening end portion of the bobbin can be reinforced. However, the intermediate portion of the bobbin to which the vibration plate is fixed is not reinforced at all. When the intermediate portion of the bobbin to which the vibration plate is fixed is not reinforced, distortion tends to occur in the bobbin and the vibration plate during a sound generation driving operation. Accordingly, there is a concern that sound quality may be deteriorated and a coil wire of the voice coil may be disconnected.

SUMMARY

The present invention has been made to address the above-described conventional problems, and an object of the invention is to provide a speaker capable of effectively reinforcing a bobbin and preventing deterioration of sound quality and disconnection of a coil wire.

According to an embodiment of the invention, there is provided a speaker including: a magnetic circuit portion supported by a frame portion and forming a magnetic gap; a hollow bobbin; a voice coil wound on the bobbin and located inside the magnetic gap; and a vibration plate disposed between the frame portion and the bobbin, in which the vibration plate is fixed to a vibration plate fixed portion located at an outer surface of an intermediate portion spaced away from an opening end portion of the bobbin, and a cap member is attached to the opening end portion of the bobbin and the cap member is provided with a bobbin reinforcement portion extending from the opening end portion toward the intermediate portion inside the bobbin and opposing the vibration plate fixed portion or opposing the vicinity of the vibration plate fixed portion.

In the speaker of the embodiment of the invention, it is preferable that the bobbin reinforcement portion is fixed to the bobbin in at least an inner surface of the vibration plate fixed portion.

In the speaker of the embodiment of the invention, it is preferable that the bobbin reinforcement portion includes a cylindrical portion opposing an inner surface of the bobbin and a bottom surface portion located at an end portion directed toward the inside of the bobbin of the cylindrical portion, and the bottom surface portion opposes the vibration plate fixed portion or the vicinity thereof.

In the speaker of the embodiment of the invention, the vibration plate fixed portion may be located at a position away from the opening end portion of the bobbin.

In the speaker of the embodiment of the invention, it is more preferable that the cap member is provided with an outer support portion extending toward an outer peripheral side in relation to the opening end portion of the bobbin, and the outer support portion is fixed to the vibration plate.

In the speaker of the embodiment of the invention, it is preferable that a damper member is provided between the frame portion and the bobbin, and the bobbin reinforcement portion also opposes a fixed portion of the damper member in the bobbin.

According to the speaker of the embodiment of the invention, many parts of the bobbin can be reinforced by the bobbin reinforcement portion of the cap, and also the vibration plate fixed portion of the bobbin is reinforced. Accordingly, it is possible to improve the rigidity of the bobbin and to improve sound characteristics.

DETAILED DESCRIPTION OF THE PREFERRED EMBODIMENTS

Figure 1:
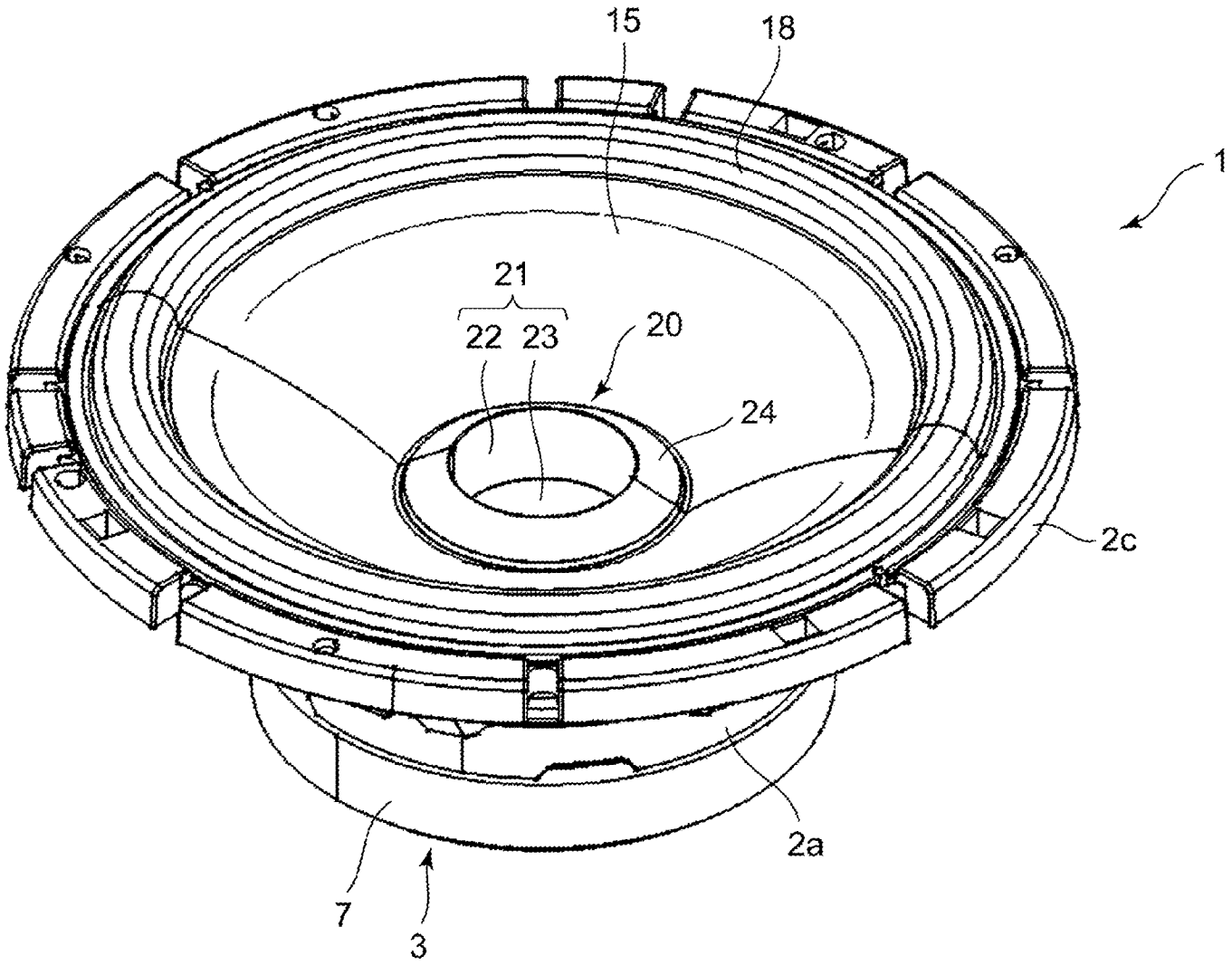
FIG. 1 is a perspective view illustrating a speaker of a first embodiment of the invention in a state in which a sound generation side faces upward.
Figure 2:
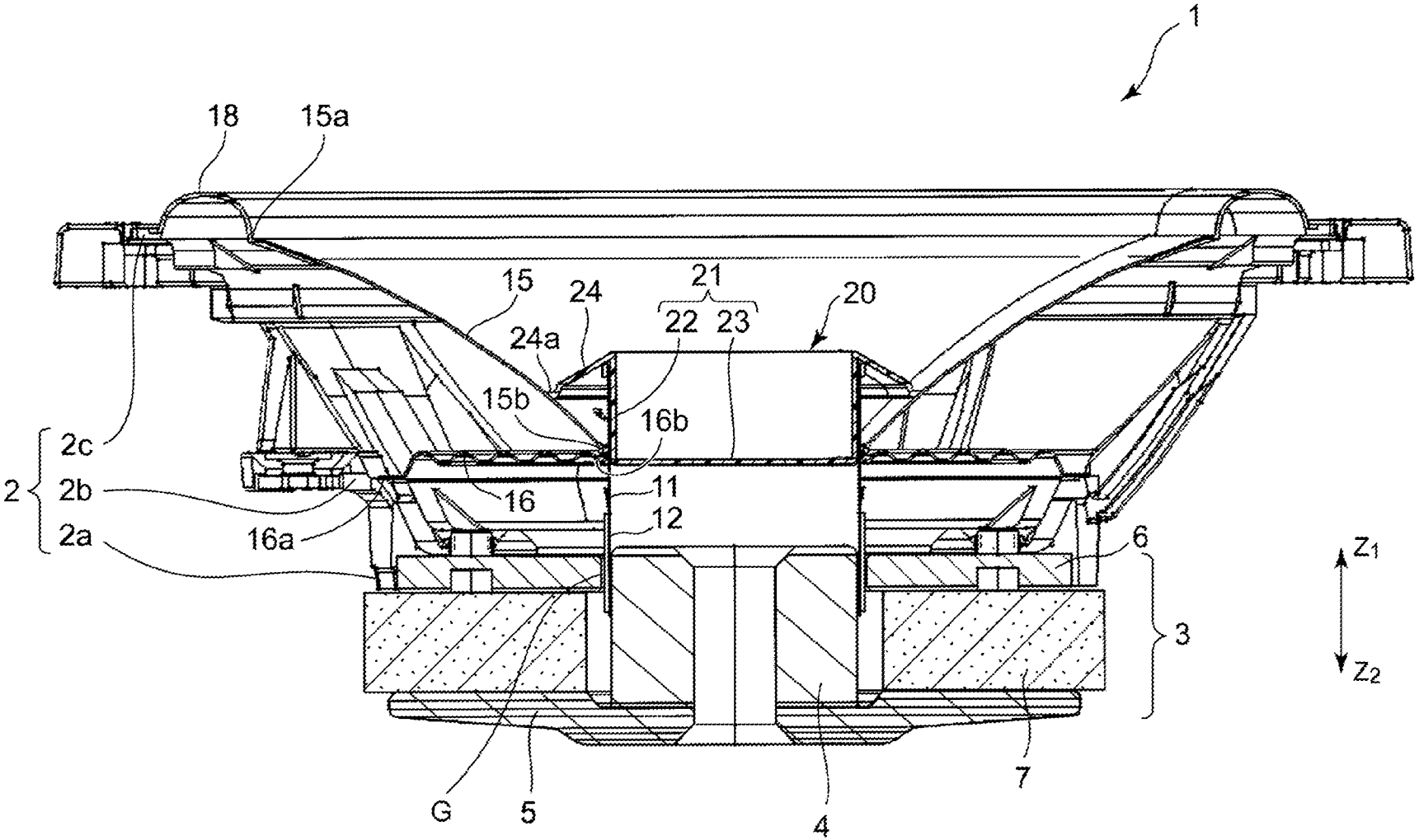
FIG. 2 is a longitudinal sectional view of the speaker of the first embodiment illustrated in FIG. 1.

A speaker 1 of a first embodiment of the invention illustrated in FIGS. 1 to 4 includes a frame portion 2. For example, the frame portion 2 is formed by die-casting light metal or is formed by press forming a steel plate. As illustrated in FIG. 2, the frame portion 2 includes a magnetic circuit portion support portion 2*a*, a damper support portion 2*b*, and a vibration plate support portion 2*c*. The frame portion 2 may be integrally formed as a whole or may be formed such that one of the magnetic circuit portion support portion 2*a*, the damper support portion 2*b*, and the vibration plate support portion 2*c* is formed separately from the other parts and these parts are combined and fixed to each other.

A magnetic circuit portion 3 is fixed to the magnetic circuit portion support portion 2*a* of the frame portion 2. As illustrated in FIG. 2, the magnetic circuit portion 3 includes a pole yoke 4 which is located at the center, a lower yoke 5 which is fixed to the lower side (the side of Z2) of the pole yoke 4, and an opposing yoke 6 which opposes the upper side (the side of Z1) of the lower yoke 5, and a magnet 7 is fixed to be interposed between the lower yoke 5 and the opposing yoke 6. The magnet 7 is an annular permanent magnet and the pole yoke 4 is located inside a center hole of the magnet 7. The upper surface (the surface on the side of Z1) and the lower surface (the surface on the side of Z2) of the magnet 7 are magnetized to different magnetic poles. A magnetic gap G is formed in an opposing portion between the pole yoke 4 and the yoke 6.

The speaker 1 is provided with a bobbin 11. The bobbin 11 is a cylindrical body of which a cross-section is a true circle and which is hollow. Alternatively, the cross-section of the bobbin 11 may be elliptical, oval, or polygonal. The bobbin 11 is made of paper or a synthetic material of paper and synthetic resin. Alternatively, the bobbin may be made of synthetic resin material. That is, the bobbin 11 is made of at least one of a paper material and a synthetic resin material and does not include a metal material. For that reason, the bobbin 11 can be low in weight. The bobbin 11 has an opening end portion 11*c* formed at an end portion in the direction Z1.

Figure 4:
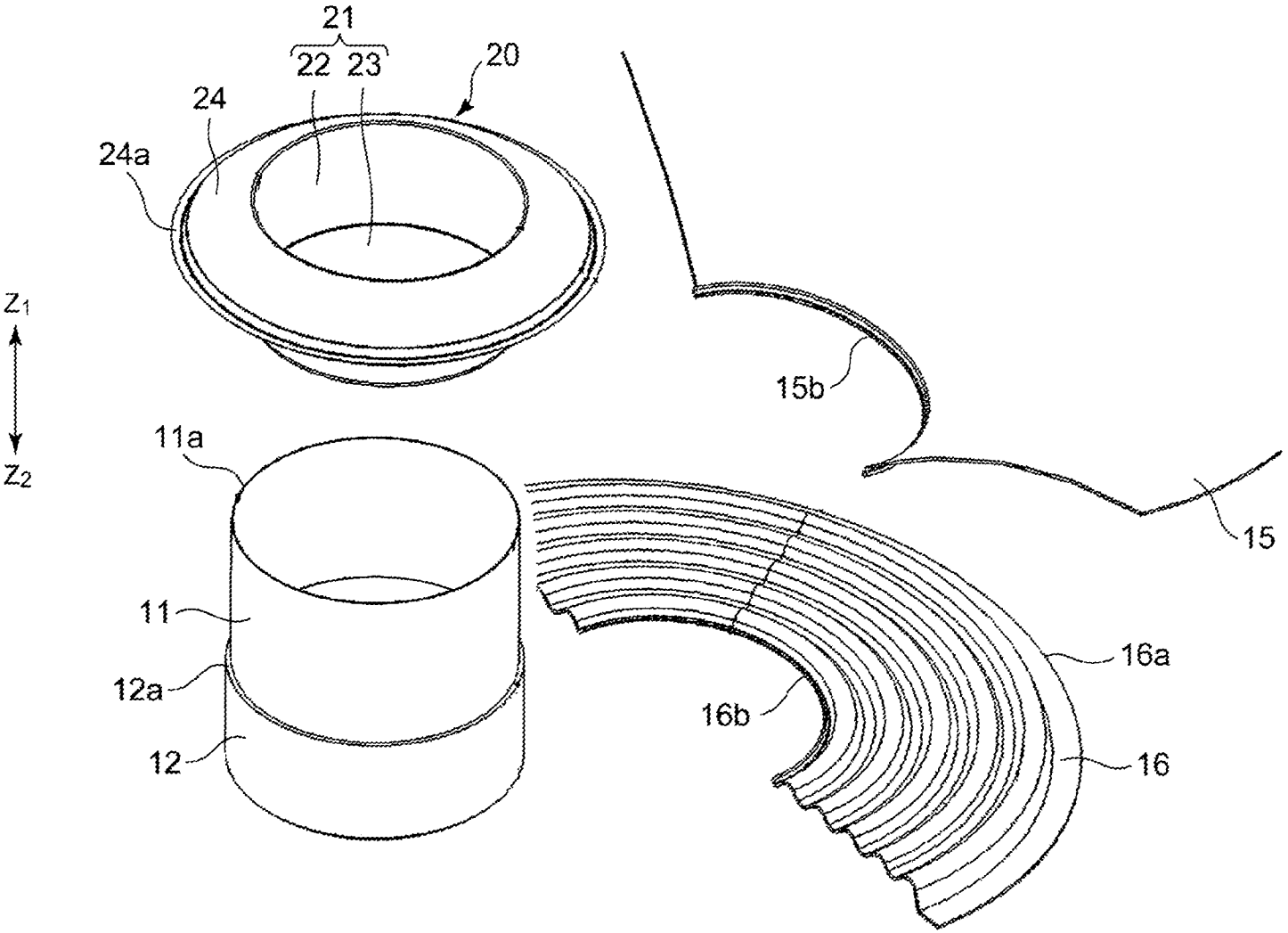
FIG. 4 is a partially exploded perspective view illustrating a part of a structure of the speaker of the first embodiment illustrated in FIG. 1 and including a partial cross-section.

As illustrated in FIGS. 2 and 4, a voice coil 12 is provided at the lower side (the side of Z2) of the bobbin 11. The voice coil 12 is formed by winding a coated wire on the bobbin 11. As illustrated in FIG. 2, a portion of the bobbin 11 on which the voice coil 12 is wound is located inside the magnetic gap G of the magnetic circuit portion 3.

As illustrated in FIG. 2, a vibration plate 15 is provided between the bobbin 11 and the vibration plate support portion 2*c* of the frame portion 2. The vibration plate 15 has a so-called cone shape and is made of, for example, paper or a synthetic material of paper and synthetic resin. Alternatively, the vibration plate 15 may be made of a synthetic resin material. That is, the vibration plate 15 is made of at least one of a paper material and a synthetic resin material.

As illustrated in FIG. 2, an outer peripheral support member 18 is provided between the vibration plate support portion 2*c* and an outer peripheral edge 15*a* of the vibration plate 15. The outer peripheral support member 18 has a curved cross-section and is deformable with the vibration of the vibration plate 15. As illustrated in the enlarged view of FIG. 3, an inner peripheral edge 15*b* of the vibration plate 15 is fixed to an outer surface 11*a* of the bobbin 11, such as by adhesive. In particular, the inner peripheral edge 15*b* is fixed to the outer surface of the bobbin 11 at an intermediate portion spaced away from the opening end portion 11*c* of the bobbin 11 in the direction Z2. In the bobbin 11, a portion to which the vibration plate 15 is fixed is a vibration plate fixed portion (i) and a portion in which the vibration plate fixed portion (i) exists is an intermediate portion spaced away from the opening end portion 11*c* by a distance L1.

Figure 3:
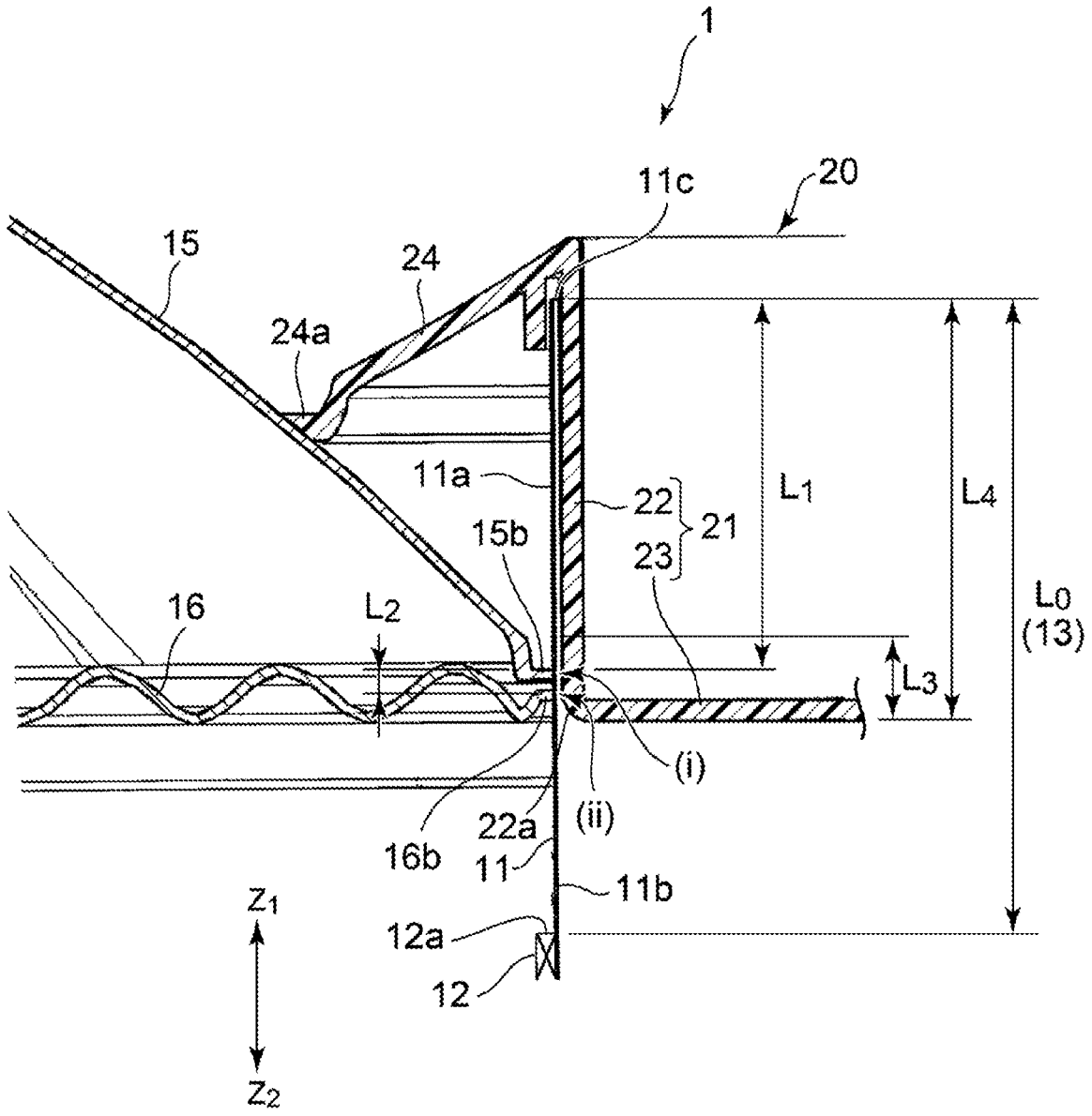
FIG. 3 is a partially enlarged cross-sectional view of a part of FIG. 2.

As illustrated in FIG. 2, a damper member 16 is provided between the bobbin 11 and the damper support portion 2*b* of the frame portion 2. FIG. 3 is an enlarged cross-sectional view of the damper member 16, and FIG. 4 is a perspective view of a part of the damper member 16.

The damper member 16 is made of, for example, a woven fabric impregnated with resin or the like. The damper member 16 is corrugated and its cross-section is corrugated. As illustrated in FIG. 2, an outer peripheral edge 16*a* of the damper member 16 is fixed to the damper support portion 2*b* of the frame portion 2. As illustrated in the enlarged view of FIG. 3, the inner peripheral edge 16*b* of the damper member 16 is fixed to the outer surface 11*a* of the bobbin 11 by adhering. In the bobbin 11, a portion to which the inner peripheral edge 16*b* of the damper member 16 is fixed is a damper member fixed portion (ii).

As illustrated in FIG. 3, the vibration plate fixed portion (i) and the damper member fixed portion (ii) of the bobbin 11 are very close to each other. When a portion of a distance L0 from the upper opening end portion 11*c* of the bobbin 11 to the upper end portion 12*a* of the voice coil 12 is set as a main body 13 of the bobbin 11, the vibration plate fixed portion (i) and the damper member fixed portion (ii) are located at the intermediate portion of the main body 13. That is, a distance L1 from the opening end portion 11*c* of the bobbin 11 to the vibration plate fixed portion (i) is ⅓ or more and ⅔ or less of the length dimension L0 of the main body 13. Further, a distance L2 between the vibration plate fixed portion (i) and the damper member fixed portion (ii) in the vertical direction is ⅕ or less and preferably 1/10 or less of the distance L0.

As illustrated in FIGS. 2 and 3, a cap member 20 is attached to the bobbin 11. The cap member 20 is fitted into the hollow inner portion of the bobbin 11 from the opening end portion 11*c* of the bobbin 11. The cap member 20 is formed by injection-molding synthetic resin and is integrally formed as a whole or is formed such that a plurality of parts formed by injection-molding synthetic resin are combined with each other.

As illustrated in the enlarged view of FIG. 3, the cap member 20 includes a cylindrical portion 22 which extends downward toward the intermediate portion from the opening end portion 11*c* inside the hollow inner portion of the bobbin 11. A bottom surface portion 23 is provided at an end portion 22*a* (an end portion on the side of Z2) facing the inside of the bobbin 11 in the cylindrical portion 22. The end portion 22*a* of the cylindrical portion 22 is completely covered by the bottom surface portion 23 and is able to prevent dust or liquid from intruding into the magnetic circuit portion 3 from a space on the side of Z1. Here, an opening may be formed in a part of the bottom surface portion 23. In the cap member 20, a bobbin reinforcement portion 21 is formed by the cylindrical portion 22 and the bottom surface portion 23.

The cylindrical portion 22 contacts the inner surface 11*b* of the bobbin 11 or opposes the inner surface 11*b* through a narrow gap. The outer peripheral surface of the cylindrical portion 22 and the inner surface 11*b* of the bobbin 11 are fixed to each other by an adhesive in at least a part thereof. It is preferable that the outer peripheral surface of the cylindrical portion 22 and the inner surface 11*b* of the bobbin 11 are fixed to each other by an adhesive in an area covering at least the vibration plate fixed portion (i) and the damper member fixed portion (ii), for example, a height range of L3 illustrated in FIG. 3. It is further preferable that the inner surface 11*b* and the outer surface of the cylindrical portion 22 adhere to each other in the entire area of the range of the height L4 in which the bobbin 11 and the cylindrical portion 22 face each other.

The height dimension L4 of the area in which the inner surface 11*b* of the bobbin 11 and the outer peripheral surface of the cylindrical portion 22 oppose each other is preferably ⅖ or more and further preferably ½ or more of the height dimension L0 from the opening end portion 11*c* of the bobbin 11 to the upper end portion 12*a* of the voice coil 12. When the height dimension is provided in the above-described range, the bobbin 11 can be effectively reinforced.

Further, the end portion 22*a* of the cylindrical portion 22 is preferably located at the lower side (the side of Z2) in relation to the vibration plate fixed portion (i) and is further preferably located at the lower side (the side of Z2) in relation to both the vibration plate fixed portion (i) and the damper member fixed portion (ii). Here, when the height dimension L4 is ⅖ or more of the height dimension L0, the end portion 22*a* of the cylindrical portion 22 may be located at the slightly upper side (the side of Z1) in relation to the vibration plate fixed portion (i) and the damper member fixed portion (ii). That is, the end portion 22*a* of the cylindrical portion 22 may be located in the vicinity of at least the vibration plate fixed portion (i) and the damper member fixed portion (ii).

The cap member 20 is provided with an outer support portion 24 which further extends to the outer peripheral side from the opening end portion 11*c* of the bobbin 11, and the peripheral edge portion 24*a* of the outer support portion 24 is fixed to a surface facing the side of Z1 in the vibration plate 15, such as by adhesive.

In the speaker 1 of the first embodiment, when a voice current flows to the voice coil 12, an electromagnetic force (magnetic energy) caused by the voice current and the magnetic field traversing the magnetic gap G of the magnetic circuit portion 3 is converted into kinetic energy in the Z1-Z2 direction of the voice coil 12. This kinetic energy is transmitted from the bobbin 11 to the vibration plate 15 so that the vibration plate 15 is vibrated and sound energy is emitted to a space.

As illustrated in FIG. 3, the bobbin 11 is reinforced by the bobbin reinforcement portion 21 of the cap member 20 in the range of the height L4 of preferably ⅖ or more of the height dimension L0 from the opening end portion 11*c* of the bobbin 11 to the upper end portion 12*a* of the voice coil 12. For that reason, it is possible to improve the rigidity of the bobbin 11 that transmits the kinetic energy. Here, since the bobbin 11 is made of at least one of a paper material and a synthetic resin material, it is possible to reduce the mass of the bobbin 11. Since the bobbin 11 is lightweight and has high rigidity, the bobbin 11 can efficiently transmit the kinetic energy applied to the voice coil 12 to the vibration plate 15 without attenuating or distorting the kinetic energy. As a result, it is possible to prevent a decrease in sound pressure and to easily maintain linearity of sound.

Further, since a resistance force is applied from the vibration plate 15 and the damper member 16 when the bobbin 11 moves in the Z1-Z2 direction, stress easily concentrates on the vibration plate fixed portion (i) and the damper member fixed portion (ii) of the bobbin 11. Particularly, since the vibration plate 15 has a large area and high rigidity, stress easily concentrates on the vibration plate fixed portion (i) in the bobbin 11. Here, as illustrated in FIG. 3, when the cylindrical portion 22 of the bobbin reinforcement portion 21 of the cap member 20 is fixed to the inner surface 11*b* of the bobbin 11 by adhering in an opposing state in the vibration plate fixed portion (i) and the damper member fixed portion (ii), it is possible to easily suppress deformation due to the concentration of stress in the vibration plate fixed portion (i) and the damper member fixed portion (ii).

Further, the bobbin reinforcement portion 21 of the cap member 20 includes the bottom surface portion 23, but when the bottom surface portion 23 is disposed in the vicinity of the vibration plate fixed portion (i) and the damper member fixed portion (ii) of the bobbin 11, the rigidity of the bobbin 11 in the vibration plate fixed portion (i) and the damper member fixed portion (ii) can be improved. Accordingly, it is possible to suppress deformation in the bobbin crushing direction and to maintain high kinetic energy transmission efficiency due to the bobbin 11.

Further, the coil wire connected to the voice coil 12 is laid from the bobbin 11 toward the vibration plate 15, but since the repeated bending of the coil wire is suppressed due to the reinforcement of the bobbin 11, a disconnection of the coil wire can be prevented.

Further, the cap member 20 includes the outer support portion 24, and the peripheral edge portion 24*a* of the outer support portion 24 is fixed to the vibration plate 15. Since the bobbin 11 can be reinforced by the cap member 20 and the vibration plate 15 can be also supported, it is possible to prevent distortion and unnecessary vibration in the bobbin 11, the inner peripheral portion of the vibration plate 15, and the like and to further easily attenuate a sound effect.

Figure 5:
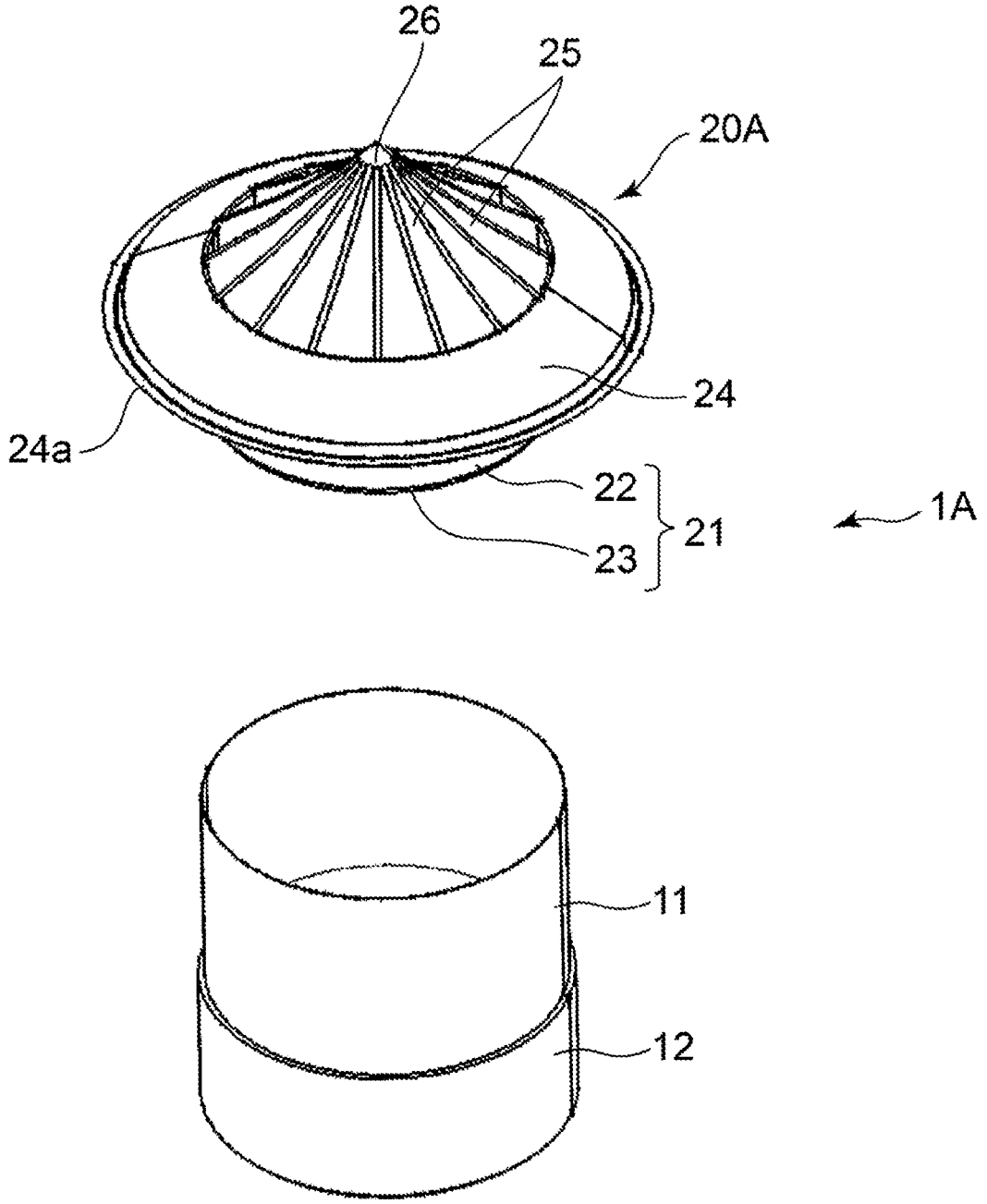
FIG. 5 is a partially exploded perspective view illustrating a part of a modified example of the speaker of the first embodiment of the invention.
Figure 6:
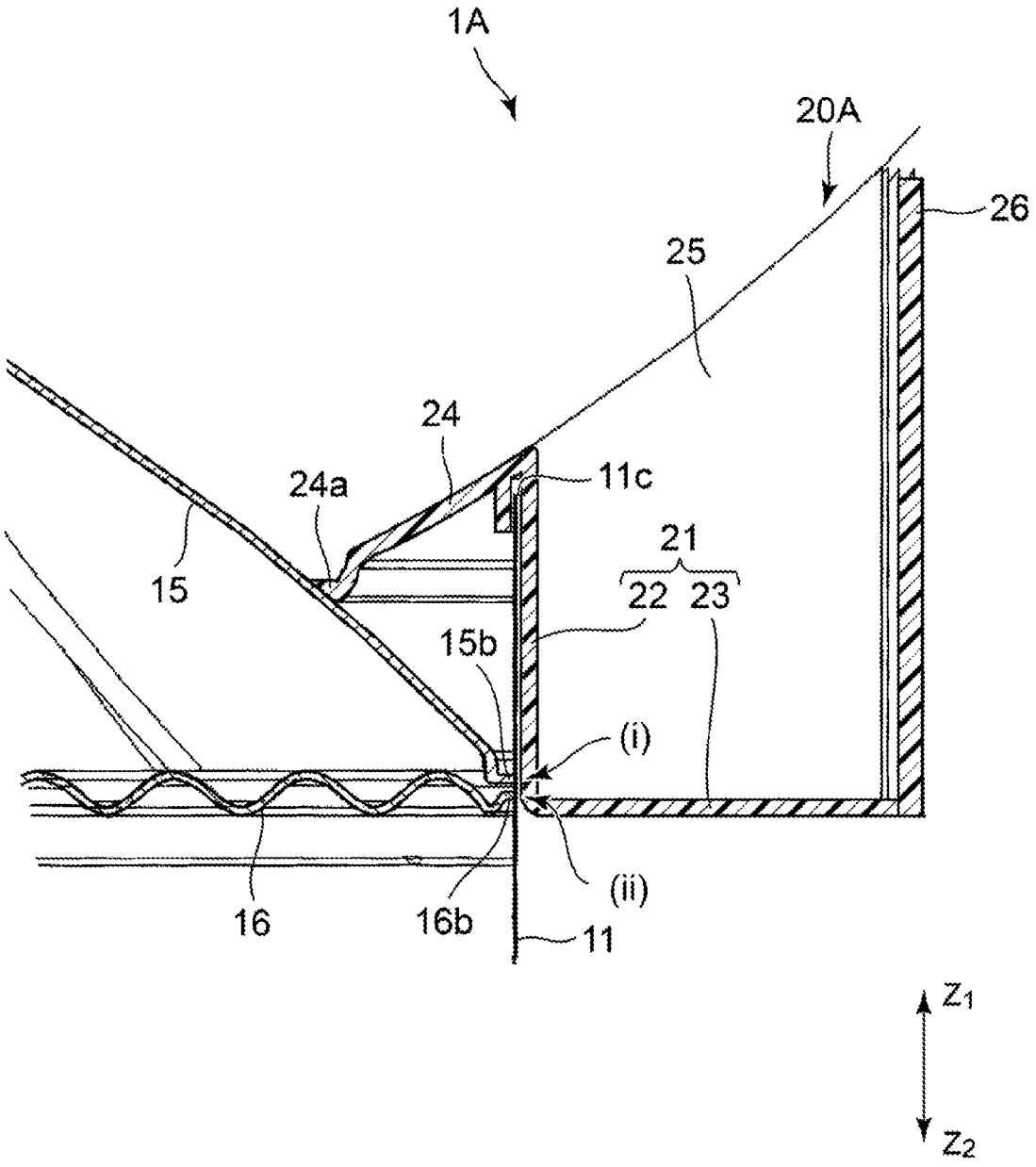
FIG. 6 is a partially cross-sectional view illustrating the speaker of the modified example illustrated in FIG. 5.

FIGS. 5 and 6 illustrate a part of a speaker 1A which is a modified example of the first embodiment of the invention. In the speaker 1A of the modified example illustrated in FIGS. 5 and 6, a cap member 20A is attached to the opening end portion 11*c* of the bobbin 11. The cap member 20A includes the cylindrical portion 22 and the bottom surface portion 23 as the bobbin reinforcement portion 21 and includes the outer support portion 24 extending from the opening end portion 11*c* toward the outer peripheral side. Further, the cap member 20A includes a support column 26 which is uprightly formed to the upper side (the side of Z1) from the center of the bottom surface portion 23, and a plurality of fins 25 extending in the Z1-Z2 direction is arranged regularly in the circumferential direction between the cylindrical portion 22 and the support column 26. Since the cap member 20A has high rigidity, the capability of reinforcing the bobbin 11 is further improved.

Figure 7:
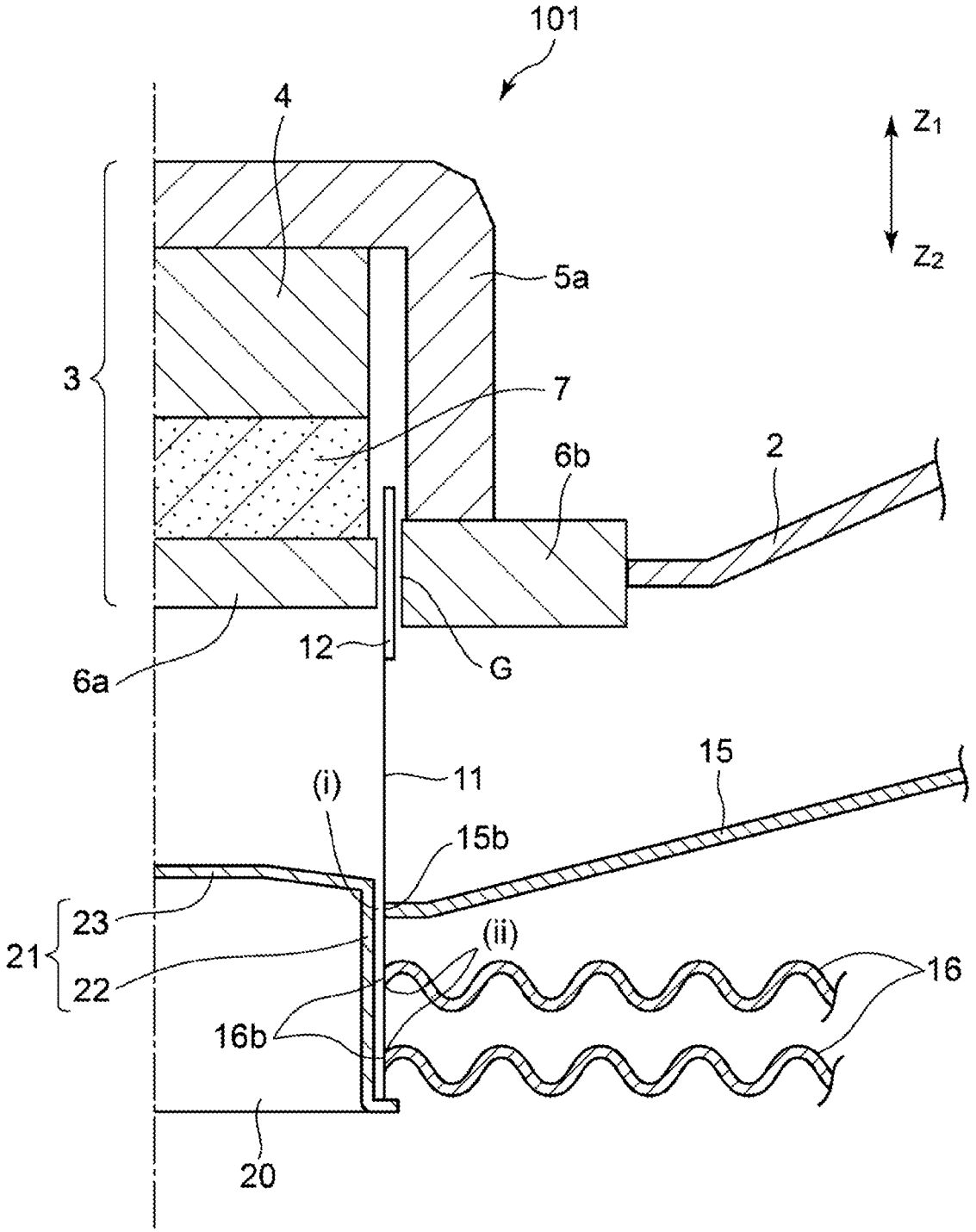
FIG. 7 is a half cross-sectional view illustrating a part of a counter drive type speaker according to a second embodiment of the invention.

FIG. 7 is a half cross-sectional view illustrating a part of a counter drive type speaker 101 which is a second embodiment of the invention.

Like the speaker 1 of the first embodiment, in the speaker 101 illustrated in FIG. 7, a direction in which an opening angle of a cone-shaped vibration plate is less than 180° is an upward direction and is directed in the Z1 direction.

In the counter drive type speaker 101, the magnetic circuit portion 3 is provided at the upper side (the side of Z1) and the magnetic circuit portion 3 is supported by the frame portion 2. The magnetic circuit portion 3 includes a pole yoke 4, an upper yoke 5*a*, and two opposing yokes 6*a* and 6*b*. The magnet 7 is fixed between the pole yoke 4 and the opposing yoke 6*a*, and the magnetic gap G is formed in the opposing portion between the yoke 6*a* and the yoke 6*b*. The voice coil 12 is wound on the bobbin 11 at the upper side, and the voice coil 12 is located inside the magnetic gap G.

The inner peripheral edge 15*b* of the vibration plate 15 is fixed to the outer surface of the bobbin 11, and the inner peripheral edges 16*b* of two damper members 16 are also fixed to the bobbin 11. The outer peripheral edge of the vibration plate 15 and the outer peripheral edge of the damper member 16 are fixed to the frame portion 2.

The cap member 20 is attached to the opening end portion at the lower side (the side of Z2) of the bobbin 11. The cap member 20 includes the cylindrical portion 22 and the bottom surface portion 23 as the bobbin reinforcement portion 21. The cylindrical portion 22 opposes the inner surface of the bobbin 11 in the vibration plate fixed portion (i) and the damper member fixed portion (ii), and the bobbin 11 and the cylindrical portion 22 are fixed to each other by adhering in at least the vibration plate fixed portion (i) and the damper member fixed portion (ii).

While there has been illustrated and described what is at present contemplated to be preferred embodiments of the present invention, it will be understood by those skilled in the art that various changes and modifications may be made, and equivalents may be substituted for elements thereof without departing from the true scope of the invention. In addition, many modifications may be made to adapt a particular situation to the teachings of the invention without departing from the central scope thereof. Therefore, it is intended that this invention not be limited to the particular embodiments disclosed, but that the invention will include all embodiments falling within the scope of the appended claims.

What is claimed is:

1. A speaker comprising:

a magnetic circuit portion supported by a frame portion and forming a magnetic gap;

a hollow bobbin;

a voice coil wound on the bobbin and located inside the magnetic gap; and a vibration plate disposed between the frame portion and the bobbin, wherein the vibration plate is fixed to a vibration plate fixed portion located at an outer surface of an intermediate portion spaced away from an opening end portion of the bobbin, and wherein a cap member is attached to the opening end portion of the bobbin, the cap member is provided with a bobbin reinforcement portion extending from the opening end portion toward the intermediate portion inside the bobbin and at least to a location along an inner surface of the bobbin opposite the vibration plate fixed portion, and the bobbin reinforcement portion contacts or is fixed by adhesive to the inner surface of the bobbin opposite the vibration plate fixed portion.

2. The speaker according to claim 1, wherein the bobbin reinforcement portion is fixed to the bobbin in at least an inner surface of the vibration plate fixed portion.

3. The speaker according to claim 1, wherein the bobbin reinforcement portion includes a cylindrical portion opposing an inner surface of the bobbin and a bottom surface portion located at an end portion of the cylindrical portion directed toward the inside of the bobbin, and the bottom surface portion opposes the vibration plate fixed portion or the vicinity thereof.

4. The speaker according to claim 1, wherein the vibration plate fixed portion is located at a position spaced away from the opening end portion of the bobbin.

5. The speaker according to claim 1, wherein the cap member is provided with an outer support portion extending toward an outer peripheral side in relation to the opening end portion of the bobbin, and the outer support portion is fixed to the vibration plate.

6. The speaker according to claim 1, wherein a damper member is provided between the frame portion and the bobbin, and the bobbin reinforcement portion also opposes a fixed portion of the damper member in the bobbin.

7. A speaker comprising:

a magnetic circuit portion supported by a frame portion and forming a magnetic gap;

a hollow bobbin having an opening end portion;

a voice coil wound on the bobbin and located inside the magnetic gap, where an upper end portion of the voice coil is spaced a distance L0 from the opening end portion of the bobbin; and a vibration plate disposed between the frame portion and the bobbin, wherein the vibration plate is fixed to a vibration plate fixed portion located at an outer surface of an intermediate portion spaced away from the opening end portion of the bobbin at a distance L1 that is between ⅓ and ⅔ of the distance L0, and wherein a cap member is attached to the opening end portion of the bobbin, the cap member is provided with a bobbin reinforcement portion extending from the opening end portion toward the intermediate portion inside the bobbin and at least to a location along an inner surface of the bobbin opposite the vibration plate fixed portion, and the bobbin reinforcement portion contacts or is fixed by adhesive to the inner surface of the bobbin opposite the vibration plate fixed portion.

8. The speaker according to claim 7, wherein the bobbin reinforcement portion is fixed to the bobbin in at least an inner surface of the vibration plate fixed portion.

9. The speaker according to claim 7, wherein the bobbin reinforcement portion includes a cylindrical portion opposing an inner surface of the bobbin and a bottom surface portion located at an end portion of the cylindrical portion directed toward the inside of the bobbin, and the bottom surface portion opposes the vibration plate fixed portion or the vicinity thereof.

10. The speaker according to claim 7, wherein the vibration plate fixed portion is located at a position spaced away from the opening end portion of the bobbin.

11. The speaker according to claim 7, wherein the cap member is provided with an outer support portion extending toward an outer peripheral side in relation to the opening end portion of the bobbin, and the outer support portion is fixed to the vibration plate.

12. The speaker according to claim 7, wherein a damper member is provided between the frame portion and the bobbin, and the bobbin reinforcement portion also opposes a fixed portion of the damper member in the bobbin.

13. A speaker comprising:

a magnetic circuit portion supported by a frame portion and forming a magnetic gap;

a hollow bobbin;

a voice coil wound on the bobbin and located inside the magnetic gap; and a vibration plate disposed between the frame portion and the bobbin, wherein the vibration plate is fixed to a vibration plate fixed portion located at an outer surface of an intermediate portion spaced away from an opening end portion of the bobbin, and wherein a cap member is attached to the opening end portion of the bobbin, the cap member is provided with a bobbin reinforcement portion extending from the opening end portion toward the intermediate portion inside the bobbin and at least to a location along an inner surface of the bobbin opposite the vibration plate fixed portion, and the cap member includes a central support column and a plurality of fins between the central support column and the bobbin reinforcement portion of the cap member where the central support column extends uprightly beyond the opening end portion of the bobbin.

14. The speaker according to claim 13, wherein the bobbin reinforcement portion is fixed to the bobbin in at least an inner surface of the vibration plate fixed portion.

15. The speaker according to claim 13, wherein the bobbin reinforcement portion includes a cylindrical portion opposing an inner surface of the bobbin and a bottom surface portion located at an end portion of the cylindrical portion directed toward the inside of the bobbin, and the bottom surface portion opposes the vibration plate fixed portion or the vicinity thereof.

16. The speaker according to claim 13, wherein the vibration plate fixed portion is located at a position spaced away from the opening end portion of the bobbin.

17. The speaker according to claim 13, wherein the cap member is provided with an outer support portion extending toward an outer peripheral side in relation to the opening end portion of the bobbin, and the outer support portion is fixed to the vibration plate.

18. The speaker according to claim 13, wherein a damper member is provided between the frame portion and the bobbin, and the bobbin reinforcement portion also opposes a fixed portion of the damper member in the bobbin.

* * * * *